US005741063A

United States Patent [19]

Yeung

[11] Patent Number: 5,741,063

[45] Date of Patent: Apr. 21, 1998

[54] WRAP-AROUND LIGHT FIXTURE FRAME WITH PIVOTING END FLANGE

[76] Inventor: Peter Kwan Wah Yeung, 4446 Frances Street, Burnaby, British Columbia, Canada, V5C 2R4

[21] Appl. No.: 623,537

[22] Filed: Mar. 29, 1996

[51] Int. Cl.[6] ..... F21S 3/00

[52] U.S. Cl. ..... 362/217

[58] Field of Search ..... 362/217

[56] References Cited

U.S. PATENT DOCUMENTS 2,640,991 6/1953 McCann ..... 362/217

*Primary Examiner*—Carroll B. Dority

[57] ABSTRACT

An improved frame for receiving tubular lamps such as conventional fluorescent light tubes. The frame has a pivoting end flange movable between a closed position covering the light sockets and an open position exposing the light sockets to permit easy insertion and withdrawal of the light tubes. Slots of sufficient size to accommodate the light tube pins are located at transverse locations corresponding to the position of light sockets. The light tube pins may be passed through the slots when the flange is pivoted to the open position. The frame has a thinner profile than standard fixtures since less clearance is required to manoeuvre light tubes into position within the frame compartment.

8 Claims, 2 Drawing Sheets

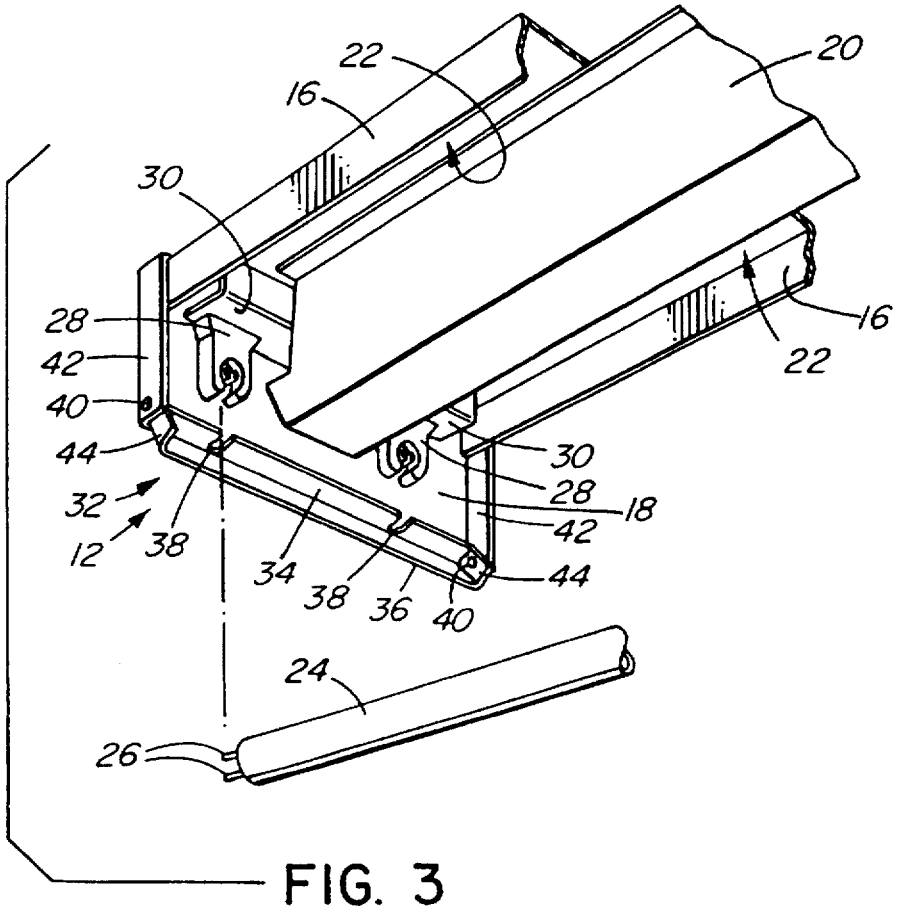
FIG. 3
FIG. 4
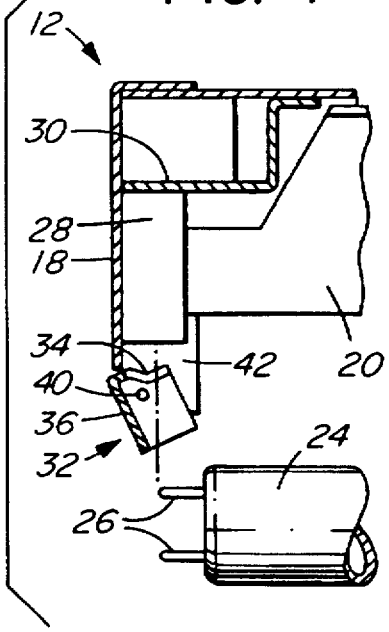
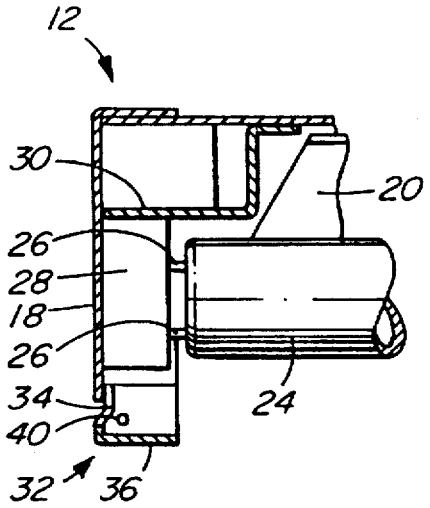
FIG. 5

WRAP-AROUND LIGHT FIXTURE FRAME WITH PIVOTING END FLANGE

FIELD OF THE INVENTION

This application relates to a frame for holding fluorescent light tubes. The frame has a pivoting end flange movable between a closed position covering the light sockets and an open position exposing the light sockets to permit easy insertion and withdrawal of the fluorescent light tubes.

BACKGROUND OF THE INVENTION

Conventional ceiling light fixtures for holding tubular lamps such as fluorescent light tubes are in common usage. Such fixtures are rectangular in shape and include opposed side walls and end walls for retaining a wrap-around cover. Ordinarily two or four fluorescent light tubes are installed in parallel in each fixture. Each light tube has a pair of pins at either end which are inserted into corresponding sockets mounted at opposite ends of the fixture adjacent the end walls. Each end wall has a flange which covers the sockets to maintain the cover in position.

The installation of fluorescent light tubes into standard fixtures is often a frustrating task for electricians. A light tube is first inserted into a longitudinal compartment of the frame and the pins at a first end of the tube are inserted into a socket. It is then necessary to place the second end of the tube into a longitudinally aligned socket at the opposite end of the frame. This may be difficult since the distance between the inner edges of the end flanges is less than the overall length of the tube. Accordingly, the clearances within the tube compartment must be sufficient to permit the second end of the tube to be swung into position within the compartment without contacting the end walls or side walls of the frame. This effectively restricts the dimensions of the frame to a minimum acceptable size (typically the end walls are no less than 1.5 inches in height).

The applicant has recognized that the short-comings in the standard wrap-around light fixture frame design may be overcome by pivotally coupling at least one of the end flanges to a corresponding end wall. In the applicant's invention, the end flange is movable to an open position permitting the second end of the light tube to be inserted directly into its corresponding socket. This avoids entirely the annoying and time-consuming task of manoeuvring the light tube within its compartment in order to fit it into position. An additional benefit is that the frame may be constructed with a more narrow profile which reduces material and transportation costs.

SUMMARY OF THE INVENTION

In accordance with the invention an improvement to frames for holding tubular lamps is disclosed. Conventional light fixture frames comprise opposed sidewalls, opposed end walls, and longitudinally aligned sockets mounted at either end of the frame adjacent the end walls for receiving pins extending from each end of a tubular lamp. The improvement comprises at least one flange pivotally coupled to at least one of the end walls and moveable between a closed position covering a socket and an open position exposing the socket.

Preferably the flange includes a slot formed therein which is vertically aligned with the socket in the open position. The slot is of a sufficient size to permit the pins to pass therethrough for insertion into a respective socket.

The flange is generally L-shaped in cross-section and comprises a first surface which extends generally parallel to the frame end wall in the closed position and a second surface which covers the socket in the closed position. The slot is formed in the first surface at a transverse location corresponding to the position of the socket. The flange first surface contacts an edge of the end wall in the open position to restrain pivoting motion of the flange outwardly.

BRIEF DESCRIPTION OF THE INVENTION DRAWINGS

In drawings which illustrate the preferred embodiment of the invention, but which should not be construed as restricting the spirit or scope of the invention in any way, FIG. 1 is an enlarged, fragmented isometric view of the applicant's light fixture frame and cover;

FIG. 3 is an isometric view of the frame of FIG. 1 with the pivoting end flange in the open position to enable insertion of one end of a tubular lamp into a corresponding socket;

FIG. 4 is a partial longitudinal sectional view of the frame of FIG. 3; and

FIG. 5 is a partial longitudinal sectional view of the frame of FIG. 3 with the tubular lamp fully inserted into the socket and the end flange pivoted to the closed position.

DETAILED DESCRIPTION OF THE PREFERRED EMBODIMENT

Figure 1:
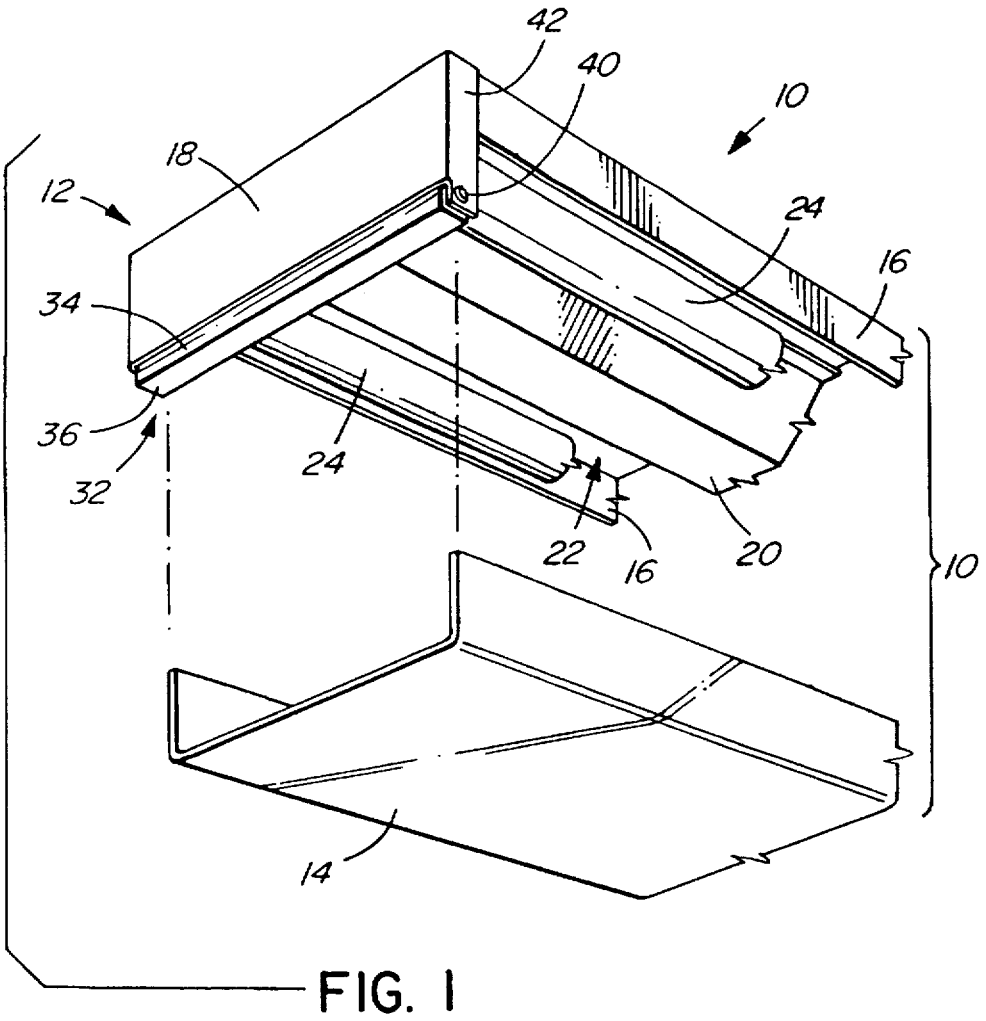

With reference to FIG. 1, this application relates to a light fixture 10 comprising a rectangular frame 12 and a wrap-around removable cover 14. Fixture 10 is mountable in ceiling panels or the like in a conventional fashion.

Frame 12 includes opposed side walls 16 and opposed end walls 18. A removable shroud 20 extends longitudinally between side walls 16 covering electrical wiring. Compartments 22 are defined between shroud 20 and an adjacent side wall for receiving tubular lamps such as fluorescent light tubes 24. As shown best in FIG. 3, each tube 24 has a pair of pins 26 extending from its respective ends which are insertable into corresponding sockets 28. Sockets 28 are mounted on supports 30 at opposite end of frame 12 adjacent an end wall 18.

In the illustrated embodiment, frame 12 is designed for holding two fluorescent tubes 24. As should be apparent to someone skilled in the art, frame 12 could be proportioned for holding any number of tubes 24. Standard size frames 12 hold two or four tubes 24. Each tube 24 is approximately 48 inches in length.

Figure 2:
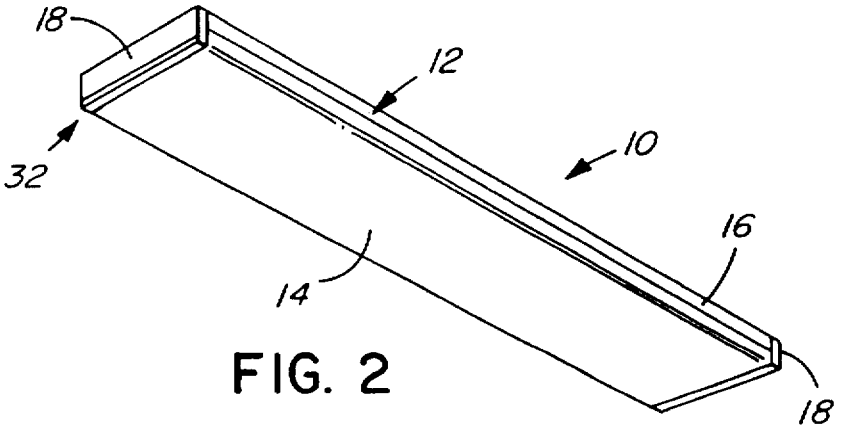
FIG. 2 is an isometric view of the frame and cover fully assembled.

Each frame end wall 18 includes an inwardly protruding flange 32 which covers one or more sockets 28. When frame 12 and removable cover 14 are assembled as shown in FIG. 2, flanges 32 maintain cover 14 in position.

In order to install a light tube 24 in a conventional frame 12, the first step is to place tube 24 into a respective longitudinal compartment 22. The pins 26 at one end of the tube 24 are inserted into a selected socket 28. The opposite end of tube 24 is then manoeuvred within longitudinal compartment 22 in order to position the second set of pins into a corresponding socket 28. In order to install each tube 24 in this manner, there must be sufficient clearance within each compartment 22 so that the inwardly protruding flanges 32 do not pose an obstruction. Ordinarily the flanges 32 are spaced at least 1.5 inches below the upper surface of the compartments 22 in order to provide sufficient clearance.

The applicant has improved the standard fluorescent light fixture design described above by pivotally coupling at least one of the flanges 32 to a respective end wall 18. This permits the flange 32 to be adjusted between a closed position shown in FIGS. 1 and 5 and an open position shown in FIGS. 3 and 4.

As shown best in FIGS. 3–5, each pivoting flange 32 is generally L-shaped in cross-section and includes a first surface 34 which extends parallel to a respective end wall 18 in the closed position and a second surface 36 which extends inwardly in the closed position to cover one or more sockets 28. Slots 38 are formed in first surface 34 at transverse locations corresponding to the position of sockets 28 (FIG. 3). Slots 38 are sufficiently large to enable the pins 26 of light tube 24 to pass therethrough for insertion into a respective socket 28.

As shown best in FIG. 4, in the open position the outer portion of first surface 34 contacts an edge of the adjacent end wall 18 to restrain pivoting motion of flange 32. In the closed position shown in FIG. 5, first surface 34 extends generally parallel to end wall 18. Flange 32 is pivotally coupled to end wall 18 at each side of frame 12 by means of fasteners 40 which extend through respective side surfaces 42, 44 end wall 18 and flange 32.

In operation, flange 32 is pivoted to the open position and pins 26 at one end of a light tube 24 are inserted into a selected socket 28. The pins 26 located at the opposite end of the light tube 24 may then be passed through a corresponding slot 38 formed in flange first surface 34 (FIG. 3) for insertion into the corresponding socket 28 at the opposite end of frame 12. The same procedure is followed to install additional light tubes 24 in adjacent longitudinal compartments 22. The pivoting flange 32 is then adjusted to the closed position shown in FIGS. 1 and 5 and the removable cover 14 is secured to frame 12. The above procedure is reversed to remove and replace light tubes 24.

The provision of a pivotable end flange 32 significantly reduces the time required to install each light tube 24 which results in productivity gains. Moreover, since less room within compartment 22 is required in order to manoeuvre each tube 24 into position, frame 12 may be constructed with a more narrow profile. For example, the overall height of end wall 18 (including flange 32 in the closed position as shown in FIG. 5) may be reduced from 1.5 inches to approximately 0.5 to 0.75 inches. This narrower profile results in lower material and transportation costs.

As should be apparent to someone skilled in the art, in an alternative embodiment of the invention the entire end wall 18 could be pivotable rather than just the flange portion 32 thereof. Flanges 32 or entire end walls 18 at either one or both ends of frame 12 could be pivotable.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. In a light fixture frame for holding at least one tubular lamp having pins extending from either end thereof, said frame having opposed sidewalls, opposed end walls, and longitudinally aligned sockets mounted at either end of said frame adjacent said end walls for receiving said pins, the improvement comprising at least one flange pivotally coupled to at least one of said end walls and moveable between a closed position covering at least one of said sockets and an open position exposing said socket.

2. The improvement as defined in claim 1, wherein said flange comprises a slot formed therein which is vertically aligned with said socket in said open position, wherein said slot is of a sufficient size to permit said pins to pass therethrough for insertion into said socket.

3. The improvement as defined in claim 2, wherein said flange is generally L-shaped in cross-section and comprises a first surface which extends generally parallel to said frame end wall in said closed position and a second surface which covers said socket in said closed position, and wherein said slot is formed in said first surface at a transverse location corresponding to the position of said socket.

4. The improvement as defined in claim 3, wherein said flange first surface contacts an edge of said end wall in said open position to restrain pivoting motion of said flange outwardly.

5. A light fixture frame for holding at least one tubular lamp having pins extending from either end thereof, said frame having opposed sidewalls, opposed end walls, and longitudinally aligned sockets mounted at either end of said frame adjacent said end walls for receiving said pins, wherein said frame further comprises a flange pivotally coupled to at least one of said end walls, said flange being pivotable between a closed position covering a socket and an open position exposing said socket.

6. The light fixture frame as defined in claim 5, wherein said flange comprises a slot formed therein which is vertically aligned with said socket in said open position, wherein said slot is of a sufficient size to permit said pins to pass therethrough for insertion into said socket.

7. The light fixture frame as defined in claim 6, wherein said flange is generally L-shaped in cross-section and comprises a first surface which extends generally parallel to said frame end wall in said closed position and a second surface which covers said socket in said closed position, and wherein said slot is formed in said first surface at a transverse location corresponding to the position of said socket.

8. The light fixture frame as defined in claim 7, wherein said flange first surface contacts an edge of said end wall in said open position to restrain pivoting motion of said flange outwardly.

* * * * *